US011471740B1

(12) United States Patent
Jamison et al.

(10) Patent No.: US 11,471,740 B1
(45) Date of Patent: Oct. 18, 2022

(54) GOLF SWING TRAINING DEVICE

(71) Applicants: John F. Jamison, Falmouth, ME (US); Scott Dana Rogers, Gorham, ME (US)

(72) Inventors: John F. Jamison, Falmouth, ME (US); Scott Dana Rogers, Gorham, ME (US)

( * ) Notice: Subject to any disclaimer, the term of this patent is extended or adjusted under 35 U.S.C. 154(b) by 0 days.

(21) Appl. No.: 17/317,371

(22) Filed: May 11, 2021

(51) Int. Cl.
*A63B 69/36* (2006.01)
*A63B 102/32* (2015.01)

(52) U.S. Cl.
CPC ..... *A63B 69/3638* (2013.01); *A63B 2102/32* (2015.10)

(58) Field of Classification Search
CPC ..... A63B 69/3638; A63B 2102/32
USPC ..... 473/219, 226, 228, 256, 437, 451, 457
See application file for complete search history.

(56) References Cited

U.S. PATENT DOCUMENTS 4,588,191 A * 5/1986 Stewart ..... A63B 69/3638 273/DIG. 30
4,729,271 A * 3/1988 Kenigson ..... B25G 1/105 81/436
5,711,718 A * 1/1998 Mueller ..... A63B 69/3638 473/234
5,776,006 A * 7/1998 Gruber ..... A63B 69/3638 403/361
6,083,116 A 7/2000 Loredo
7,588,500 B2 * 9/2009 Hoeckl ..... A63B 69/3638 473/226
8,500,609 B1 8/2013 Williams
2005/0277491 A1 * 12/2005 Nolan ..... A63B 21/06 473/519

* cited by examiner

*Primary Examiner* — Nini F Legesse
(74) *Attorney, Agent, or Firm* — Eric Karich; Karich & Associates

(57) ABSTRACT

A golf swing training device has a main housing including a first section and a second section. First and second faces of the first and second sections, respectively, each may have first and second channels. A hinge connects the first and second sections such that the first channel aligns with the second channel to form a conduit through the main housing. Removable inserts fit within the first and second channels, each removable insert having an insert channel, wherein each insert channel aligns to form a bore sized to receive the shaft of the golf club. A fastener is positioned opposite the hinge for securing the first and second sections of the main housing together around the golf club shaft.

7 Claims, 3 Drawing Sheets

GOLF SWING TRAINING DEVICE

BACKGROUND OF THE INVENTION

Field of the Invention

This invention relates generally to golf training equipment, and more particularly to a golf swing training device that attaches to the shaft of a golf club.

Description of Related Art

In the game of golf, to maximize the effectiveness of force transfer during a swing, a player uses specific muscle groups to control the path of the club and propel it forward. A smooth, fluid transfer from inside to outside takes trained muscle memory and control. Players who lack the muscle strength to execute well-controlled swings will often hook or slice to a side of the target region. To improve their overall golf game, players will sometimes train at home by swinging clubs in an open area. Weight can be added to the training exercises to improve wrist strength beyond that which is needed to swing a standard club. The introduction of too much initial weight during training could result in in injury to the wrists or arms of a player. It is therefore desirable to have a golf club swing training device that allows a user to gradually increase the weight of the device as wrist strength improves.

Loredo (U.S. Pat. No. 6,083,116) teaches a golf club weight system for use as a training or stretching device in which the weight system is adapted for easy attachment and detachment to a golf club shaft, and permits precise weight adjustments to be made to the device to meet the individual needs of a particular golfer. The golf club weight system consists of a housing containing a first section and a second section, the first section and second section having a general planar surface and corresponding channels extending axially from top to bottom of the device. The channel of the first section aligns with the channel of the second section to form a bore for receiving a portion of the golf club shaft. The housing further contains a plurality of openings for receiving removable weights. The openings consist of internal bores that are located within the sections of the housing.

Williams (U.S. Pat. No. 8,500,609) teaches an attachable weight assembly having separable sections for attachment to a pole used in exercising. The weight assembly includes a elongated main body having a first end and a second end and a bore running through the first end, second end and elongated main body. The bore is sized to fit over a shaft. The first and second ends each have a storage area for secure storage of a molded weight. The elongated main body is separable into at least two main body sections. The main body sections are attached together using an attachment mechanism. A user attaches the weight assembly to the shaft for use during exercise.

The prior art teaches golf swing training devices having removable weights. However, the prior art does not teach a golf swing training device that attaches to the club's center of gravity and is adjustable to different golf club shafts, and further includes a fastener as described herein. The present invention fulfills these needs and provides further advantages as described in the following summary.

SUMMARY OF THE INVENTION

The present invention teaches certain benefits in construction and use which give rise to the objectives described below.

The present invention provides a golf swing training device for attachment to a center of gravity of a shaft of a golf club. The golf swing training device comprises a main housing having a first section with a first face, and a second section with a second face, each of the first and second faces having a top and a bottom. The first and second faces have first and second channels, respectively, the first and second channels extending from the top to the bottom of the main housing. A hinge connects the first and second sections such that the first channel aligns with the second channel to form a conduit through the main housing. Removable inserts fit within the first and second channels, each removable insert having an insert channel, wherein each insert channel aligns to form a bore sized to receive the shaft of the golf club. At least one weight may be fastened to the main housing, and a fastener is positioned opposite the hinge for securing the first and second sections of the main housing together around the golf club shaft.

A primary objective of the present invention is to provide a golf swing training device having advantages not taught by the prior art.

Another objective is to provide a golf swing training device that is adjustable to different golf club shafts.

A further objective is to provide a golf swing training device that includes a fastener as described herein.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a golf swing training device and method of use.

Figure 1:
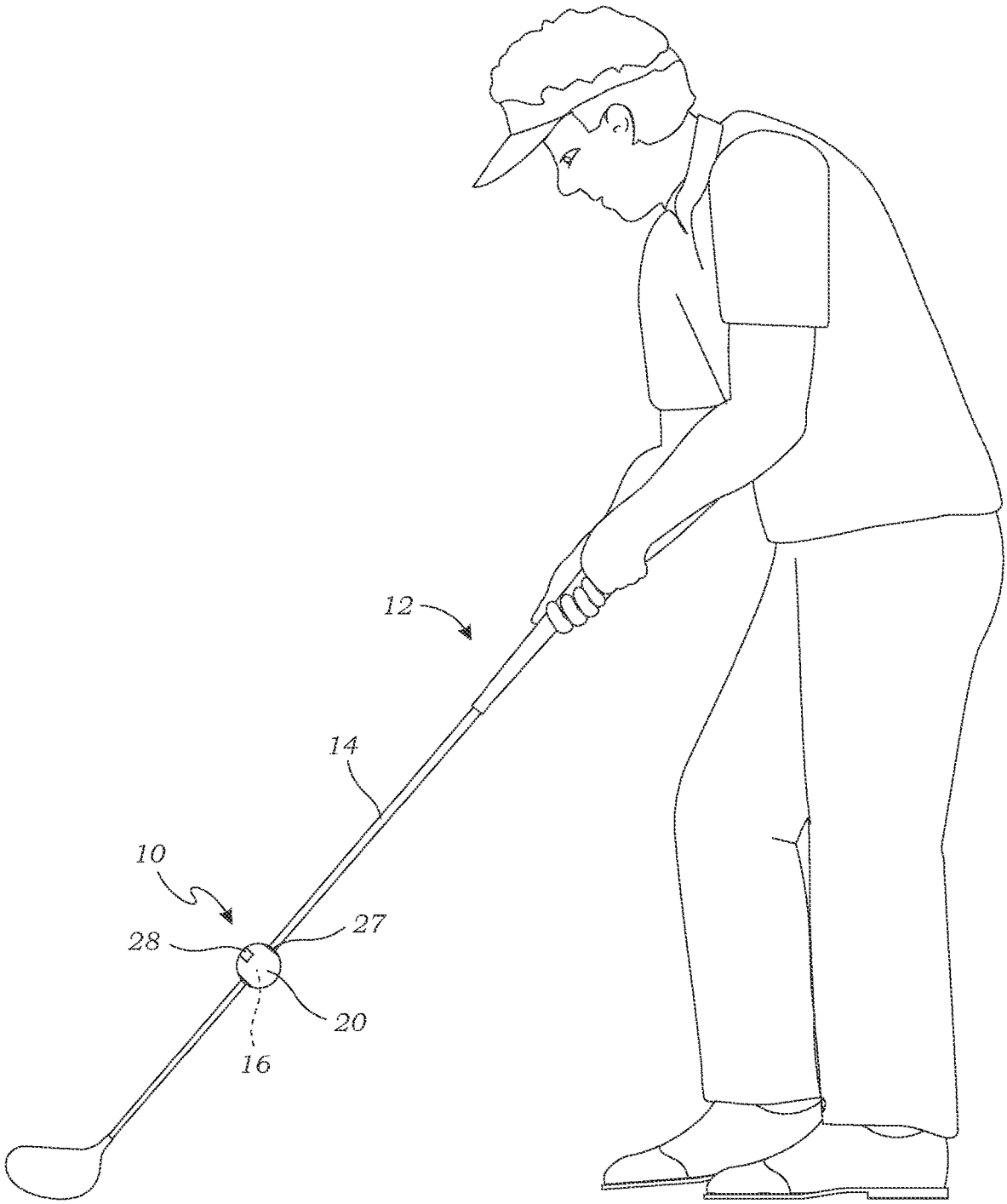
FIG. 1 is a perspective view of a person using a golf swing training device according to one embodiment of the present invention.

FIG. 1 is a perspective view of a person using the golf swing training device 10 according to one embodiment of the present invention. As shown in FIG. 1, a main housing 20 of the golf swing training device 10 is adapted to attach to a shaft 14 of a golf club 12 at a center of gravity 16 of the golf club 12, for adding weight to the golf club 12, for warmup, stretching, and/or training purposes. A method of attaching the golf swing training device 10 to the shaft 14, and using the golf swing training device 10, is discussed in greater detail below.

Figure 2:
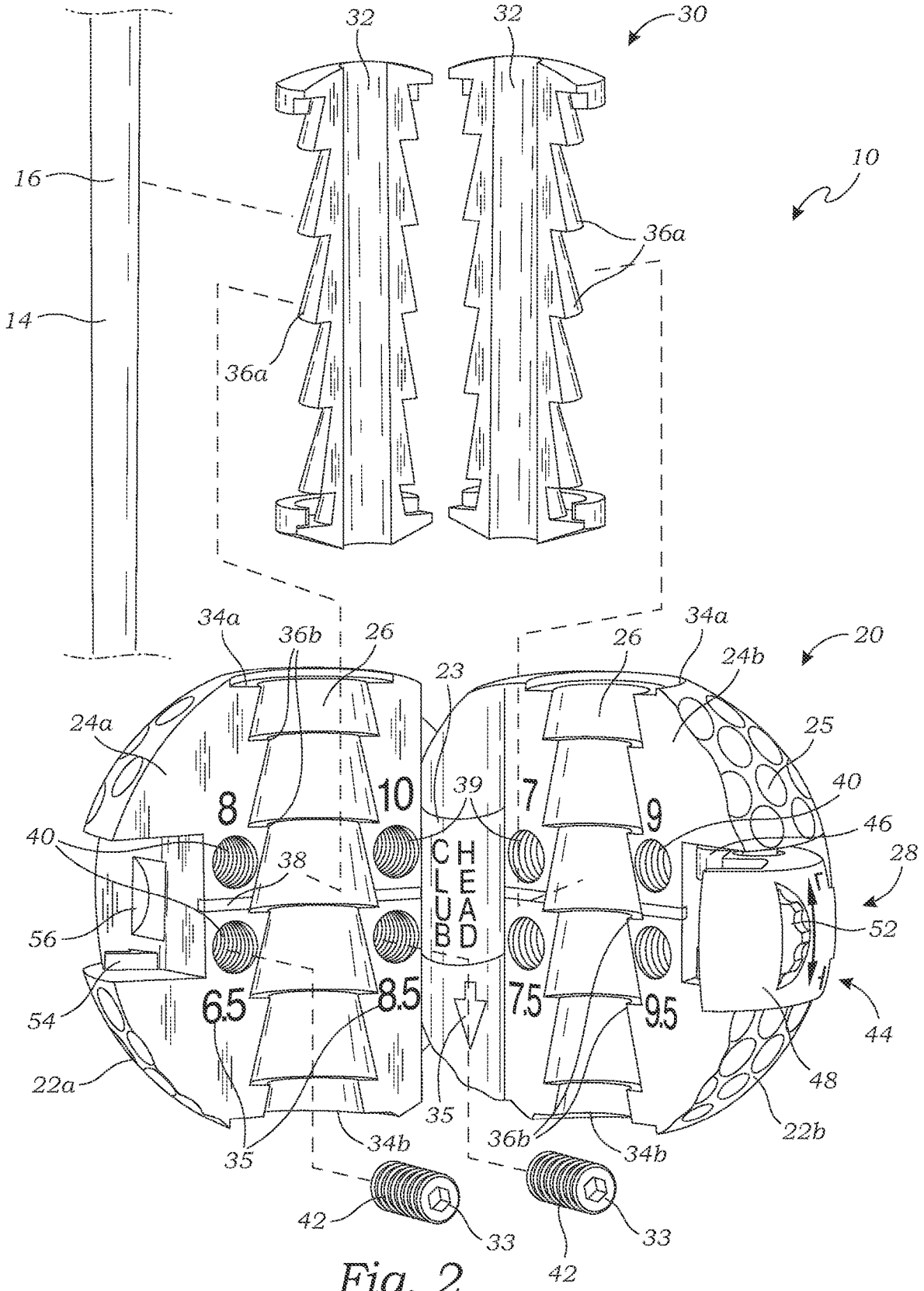
FIG. 2 is an exploded perspective view of the golf swing training device.

FIG. 2 is an exploded perspective view of the golf swing training device 10. As shown in FIG. 2, the golf swing training device 10 comprises the main housing 20 that includes first and section sections 22*a* and 22*b* connected by a hinge 23, each section 22*a* and 22*b* having a removable insert 30. The sections 22*a* and 22*b* may be constructed of any suitable material, but in this embodiment they are formed of a rigid material such as plastic or resin.

As shown in FIG. 2, in this embodiment, the first and second sections 22*a* and 22*b* together combine to form a structure, in this case one that is generally spherical shape, and include an aerodynamic outer surface 25 (e.g., dimpled as in a golf ball, having drag-reduction paint, etc.). However, in other embodiments, the first and second sections 22*a* and 22*b* may form any other shape that may be deemed suitable for attaching to a golf club shaft 14 and practicing golf swings. Furthermore, in alternative embodiments, the first and second sections 22*a* and 22*b* may not include the aerodynamic outer surface 25.

The removable inserts 30 each have insert channels 32 that align to form a bore 29 sized to receive the shaft 14 of the golf club 12, discussed in greater detail below. The removable inserts 30 in the embodiment are formed of an elastic material, such as rubber, silicone, or similar material, which are both moldable and preferably have a high coefficient of friction for best gripping the shaft of the golf club.

As shown in FIG. 2, the first and second sections 22*a* and 22*b* of the main housing 20 include a first face 24*a*, and a second face 24*b*, respectively, each of the first and second faces 24*a* and 24*b* having a top 34*a* and a bottom 34*b*. The first and second faces 24*a* and 24*b* include first and second channels 26, respectively, the first and second channels 26 extending from the top 34*a* to the bottom 34*b* of the main housing 20. The hinge 23 connects the first and second sections 22*a* and 22*b* such that the first channel aligns with the second channel to form a conduit 27 through the main housing 20. The removable inserts 30 fit within the first and second channels 26, and the bore 29 formed by the insert channels 32 is located within the conduit 27 when the main housing 20 is in a closed position (FIG. 1).

In this embodiment, as shown in FIG. 2, the removable inserts 30 further include a plurality of teeth that project outwardly 36*a*, and the first and second channels 26 of the main housing 20 further include a plurality of teeth that project inwardly 36*b* to receive the plurality of teeth of the removable inserts 30. In some embodiments, the plurality of teeth 36*b* has a taper that is opposite and greater than the taper of the golf club shaft 14, and the plurality of teeth 36*a* has a taper that is approximately the same as the taper of the golf club shaft 14. Due to the removability of the inserts 30, this angle may be adjusted for different golf club shafts, and the diameter of the bore 29 may further be similarly adjusted. For example, different shafts (e.g., graphite, steel, etc.) may be different diameters, usually around 0.5 in in diameter. The removable inserts 30 may be constructed of an elastic material that conforms to and grips the shaft of the golf club (e.g., silicone, rubber, vinyl, a hybrid material, etc.), or any material capable of being molded to receive the shaft 14 of the golf club 12.

The main housing 20 may further include at least one weight 33 mounted on or within the main housing 20, and a fastener 28 for securing the first and second sections 22*a* and 22*b* of the main housing 20 together around the golf club shaft 14. In this embodiment, the at least one weight 33 mounted on or within the main housing 20 includes a plurality of removable weights 33. In this embodiment, the removable weights 33 are in the form of ½ oz weights, and may be any number of weights, being any desired size, weight (i.e., having different density per volume), or structural shape, provided the plurality of weights 33 are capable of attaching to and providing a generally balanced weight distribution on the first and second sections 22*a* and 22*b*.

In this embodiment, the main housing 20 further comprises a plurality of bores 40 formed within the first and second faces 24*a* and 24*b*, each for receiving one of the plurality of removable weights 33. As shown in FIG. 2, in this embodiment, a centerline indicator 38 is formed on at least one of the first and second faces 24*a* and 24*b* of the main housing 20, the centerline indicator 38 is used to locate the golf swing training device 10 at the a center of gravity 16 on the shaft 14 of the golf club 12. The function of the centerline indicator 38 is explained in more detail below in the discussion of the method of use of the golf swing training device 10. In some embodiments, indicia 35 is formed or printed on the first and/or second faces, which may include numbers for weight guidance, arrows, etc. or any other indicia desired.

In some embodiments, the plurality of bores 40 are in the form of pairs of bores 40 on either side of and equidistant from the centerline indicator 38. In this embodiment, there are 4 bores 40 in each of the first and second faces 24*a* and 24*b* that align with each other when the main housing 20 is in the closed position, all 8 bores 40 together being adapted to receive a maximum of 4 oz in ½ oz weights 33. However, depending on the type and size of weight, and number and depth of the plurality of bores 40, different maximum weights may be easily achieved. Furthermore, the plurality of bores 40 may not necessarily align, as long as it is possible for the weight to be distributed approximately evenly between the first and second sections 22*a* and 22*b*.

As shown in FIG. 2, in some embodiments, the plurality of bores 40 each include a threaded inner surface 39 which threadedly receives one of the removable weights 33 via an external threaded surface 42 of each of the removable weights 33. However, in other embodiments, the plurality of bores 40 and removable weights 33 may not include the threaded inner surface 39 and external threaded surface 42, and may instead be secured by friction, magnets, or any other form of mechanical fastening mechanism (e.g., pin, etc.). They may also be unsecured, as the closing to the housing 20 will hold them in place. Furthermore, while one example is illustrated, the removable weights 33 may be attached via means other than the plurality of bores 40 (e.g., via pegs, slots, within the removable inserts 30, etc.), depending on the size and shape of the plurality of weights 33.

The fastener 28 that secures the main housing 20 in the closed position is located opposite the hinge 23 for securing first and second sections 22*a* and 22*b* of the main housing 20 together around the golf club shaft. In this embodiment, the fastener 28 is in the form of a latch, further details being shown in FIG. 3 and discussed below.

Figure 3:
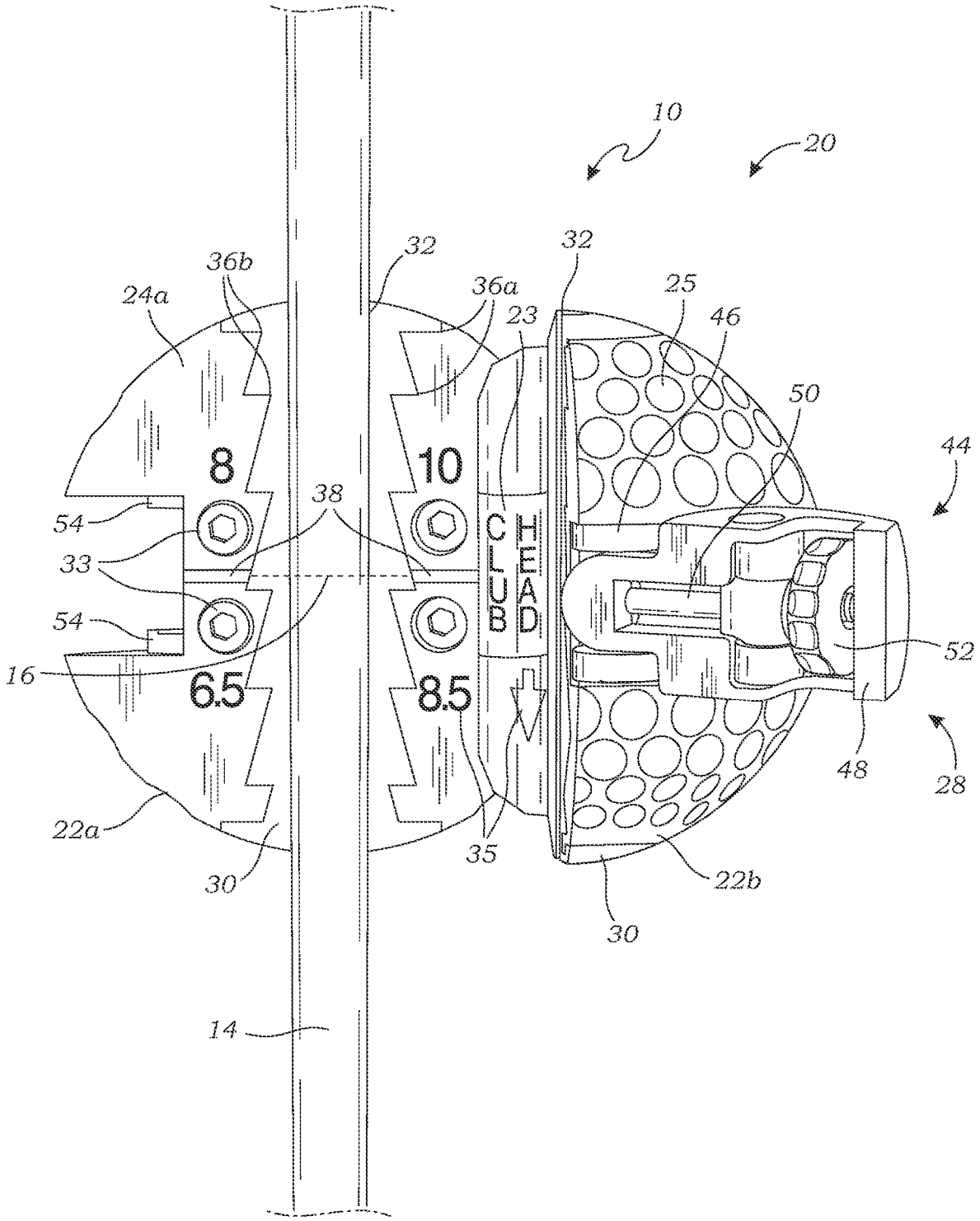
FIG. 3 is an assembled perspective view of the golf swing training device, illustrating a fastener of the golf swing training device used to fasten closed a main housing of the golf swing training device.

FIG. 3 is an assembled perspective view of the golf swing training device 10, illustrating the fastener 28 of the golf swing training device 10 used to fasten closed the main housing 20 of the golf swing training device 10. As shown in FIGS. 2-3, in some embodiments, the fastener 28 comprises a tightening mechanism 44 including a hinged portion 46, a latching portion 48, and an adjustable portion 50 that adjusts a distance between the hinged portion 46 and the latching portion 48.

In this particular embodiment, the latching portion 48 engages a receiver 54 adjacent a recess 56 in the first face 22*a*. The latching portion 48 removably interlocks with the receiver 54. The adjustable portion 50 may include an adjustment mechanism 52 (e.g., a knob, dial, etc.) on the latching portion 48 that rotates to adjust the distance between the latching portion 48 and the hinged portion 46. While one example of the fastener 28 is illustrated, any fastener may be used according to the teachings of the present invention, i.e., a different form of fastener including an adjustment/tightening portion such as a screw and washer, etc., or a fastener that secures the first and second sections 22*a* and 22*b* together without a separate adjustment mechanism, e.g., a ratchet, hook and loop strips, a plurality of adjustment slots, etc. or any other mechanisms known to those skilled in the art.

FIG. 3 illustrates a method for installing and using the golf swing training device 10. First, a desired number of the removable weights 33 may be added into the plurality of bores 40 to achieve the desired weight. The weights 33 may be added in an alternating order such that balance is maintained around the centerline indicator 38. In some embodiments, the indicia 35 indicate the sequence that the weights 33 should be added.

Second, a center of gravity 16 of the golf club 12 may be determined (e.g., by horizontally balancing the golf club 12 on a user's finger to find the approximate center of gravity 16). This is where the golf swing training device 10 is to be installed, so that the swing characteristics of the club are not altered. The golf club shaft 14 is then positioned in one of the first or second channels of the main housing 20 such that the centerline indicator 38 of the first and second faces 24*a* and 24*b* is aligned with the center of gravity 16 determined by the user.

The user may then adjust the adjustment portion, and then close the main housing 20 using the fastener 28. A final step of the method includes performing golf swing training exercises, and repeating the last three steps to adjust the number of the plurality of weights 33 within the golf swing training device 10 as desired between exercises.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A golf swing training device for attachment to a shaft of a golf club, the golf swing training device comprising:

a main housing comprising a first section having a first face, and a second section having a second face, each of the first and second faces having a top and a bottom;

first and second channels located on the first and second faces, respectively, the first and second channels extending from the top to the bottom of the main housing;

a hinge connecting the first and second sections such that the first channel aligns with the second channel to form a conduit through the main housing;

removable inserts that fit within the first and second channels, each removable insert having an insert channel, wherein each insert channel aligns to form a bore sized to receive the shaft of the golf club;

a fastener opposite the hinge for securing the first and second sections of the main housing together around the golf club shaft; and further comprising a centerline indicator on at least one of the first and second faces of the main housing, the centerline indicator being located at a center of gravity of the main housing.

2. The golf swing training device of claim 1, further comprising a plurality of removable weights, and further comprising a plurality of bores formed within the first and second faces of the main housing, each for receiving one of the plurality of removable weights; and wherein the plurality of bores are disposed in pairs of bores on either side of and equidistant from the centerline indicator.

3. The golf swing training device of claim 2, wherein each of the bores includes a threaded inner surface which threadedly receives one of the removable weights via an external threaded surface of each of the removable weights.

4. The golf swing training device of claim 1, wherein the fastener is in the form of a latch.

5. The golf swing training device of claim 1, wherein each removable insert is constructed of an elastic material that conforms to and grips the shaft of the golf club.

6. A golf swing training device for attachment to a shaft of a golf club, the golf swing training device comprising:

a main housing comprising a first section having a first face, and a second section having a second face, each of the first and second faces having a top and a bottom;

first and second channels of the first and second faces, respectively, the first and second channels extending from the top to the bottom of the main housing;

a hinge connecting the first and second sections such that the first channel aligns with the second channel to form a conduit through the main housing;

removable inserts that fit within the first and second channels, each removable insert having an insert channel, wherein each insert channel aligns to form a bore sized to receive the shaft of the golf club;

a fastener opposite the hinge for securing the first and second sections of the main housing together around the golf club shaft;

the removable inserts further include a plurality of teeth that project outwardly; and wherein the first and second channels of the main housing further include a plurality of teeth that project inwardly to receive the plurality of teeth of the removable inserts.

7. A method for training comprising the steps of:

providing a golf club having a head and a shaft;

providing a golf swing training device comprising:

a main housing comprising a first section having a first face, and a second section having a second face, each of the first and second faces having a top and a bottom;

first and second channels of the first and second faces, respectively, the first and second channels extending from the top to the bottom of the main housing;

a hinge connecting the first and second sections such that the first channel aligns with the second channel to form a conduit through the main housing;

removable inserts that fit within the first and second channels, each removable insert having an insert channel, wherein each insert channel aligns to form a bore sized to receive the shaft of the golf club;

a fastener opposite the hinge for securing the first and second sections of the main housing together around the golf club shaft; and further comprising a centerline indicator on at least one of the first and second faces of the main housing, the centerline indicator being located at a center of gravity of the main housing;

determining a center of gravity of the golf club by horizontally balancing the golf club;

attaching the golf swing training device to the shaft of the golf club so that the centerline indicator of the golf swing training device is positioned on the center of gravity determined for the golf club; and swinging the golf club.

* * * * *